US008096721B2

(12) United States Patent
Carroll et al.

(10) Patent No.: US 8,096,721 B2
(45) Date of Patent: Jan. 17, 2012

(54) RETRACTABLE SOLID OR SEMI-SOLID SUBSTANCE DISPENSER

(76) Inventors: Craig Carroll, Newport Beach, CA (US); Steve Armstrong, San Juan Capistrano, CA (US)

( * ) Notice: Subject to any disclaimer, the term of this patent is extended or adjusted under 35 U.S.C. 154(b) by 960 days.

(21) Appl. No.: 12/056,521

(22) Filed: Mar. 27, 2008

(65) Prior Publication Data

US 2009/0245922 A1 Oct. 1, 2009

(51) Int. Cl.
*B43K 21/02* (2006.01)

(52) U.S. Cl. ..... 401/59; 401/108

(58) Field of Classification Search ..... 401/98, 401/81–83, 101, 102, 107–109, 59, 60
See application file for complete search history.

(56) References Cited

U.S. PATENT DOCUMENTS

| | | | | |
|---|---|---|---|---|
| 2,559,906 | A * | 7/1951 | Tursky | 401/75 |
| 3,359,992 | A | 12/1967 | Cishek et al. | |
| 4,808,022 | A * | 2/1989 | Iizuka et al. | 401/176 |
| 5,048,990 | A | 9/1991 | Hashimoto et al. | |
| 5,171,096 | A | 12/1992 | Perrotti | |
| 6,065,465 | A * | 5/2000 | Fukada | 126/38 |
| 6,283,658 | B1 | 9/2001 | Estevez et al. | |
| 6,554,516 | B1 | 4/2003 | Christopher | |
| 7,331,730 | B2 | 2/2008 | Fukui et al. | |
| 2004/0184865 | A1 | 9/2004 | Carroll | |
| 2006/0002756 | A1 | 1/2006 | Kageyama et al. | |
| 2007/0166095 | A1 | 7/2007 | Samuelson et al. | |

FOREIGN PATENT DOCUMENTS

| | |
|---|---|
| WO PCT/US2008/074957 | 11/2008 |
| WO PCT/US2008/074958 | 11/2008 |

* cited by examiner

*Primary Examiner* — Huyen Le
(74) *Attorney, Agent, or Firm* — John K. Buche; Buche & Associates, P.C.

(57) ABSTRACT

The application relates to a solid or semi-solid substance dispenser featuring a body, an opening, and a retractable barrel which may be electively presented at the opening whereby the solid or semi-solid substance might be projected from the barrel for application to a target.

3 Claims, 8 Drawing Sheets

RETRACTABLE SOLID OR SEMI-SOLID SUBSTANCE DISPENSER

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of Invention

The present application is in the field of apparatus for dispensing medicated, cosmetic, or sun screening substances for topical application. More specifically, the present application is in the field of apparatus for dispensing and topically applying lip balm, lip stick, or salve. More generally, the present application is in the field of apparatus for dispensing substances which form a protective or occlusive layer over a target region after topical application.

2. Background of the Invention

The ideal solid and/or semi-solid substance dispenser is non-messy, portable, capable of storage, rapid delivery and easy application of a substance. Typical dispensers simply consist of a barrel and a twist-driver or push-up driver which are operated by rotating the driver relative to the barrel or application of a coaxial force on the substance to project substance from the muzzle.

Ordinarily, solid and/or semi-solid substance dispensers come equipped with a detachable lid or cap that is pulled or twisted off from the dispenser to expose the muzzle. The purpose of the lid is to protect the substance from outside corruption and prevent unintentional transfer of substance. One problem with this type of dispenser is that a contained substance can be wasted through inadvertent placement of the cap onto the substance while the substance is projected, thereby smashing or breaking off the projected substance. Such unmindful removal or replacement of the lid over the substance invariably smears the substance to the outside or the attaching portion of the lid. When this happens, subsequent lid removal becomes increasingly difficult and the cosmetic substance unwittingly dirties the dispenser user's hands. It is also difficult, with the traditional dispenser to maintain an uncontaminated substance. Another drawback for this type of dispenser is that it requires two hands to remove the lid. Yet another problem is that the removable cap can easily be lost.

Solid and/or semi-solid dispensers typically do not protect the barrel. In fact, the user usually grips the barrel directly during dispenser use. Such direct interaction with the barrel invariably leads to deformation of the barrel which either similarly deforms the contained substance or clogs the barrel completely.

SUMMARY OF THE INVENTION

Accordingly, it is an objective of the present application to provide a solid and/or semi-solid dispensing apparatus featuring a retractable barrel that permits elective exposure or concealment of the barrel.

It is a further object of the present application to provide a dispensing apparatus which allows elective projection of a substance from a retractable barrel.

It is yet a further object of the present application to provide a dispensing apparatus without a detachable lid or cap, but which apparatus still protects the applicator from outside corruption.

It is yet a further object of the present application to provide a dispensing apparatus which may be opened and closed sufficiently with one hand.

It is yet a further object of the present application to provide a dispensing apparatus which allows for opening and closing of the dispenser while substance is still projected from the dispenser.

it is yet a further object of the present application to provide a dispensing apparatus wherein the user need not directly grip the barrel during use.

BRIEF DESCRIPTION OF THE FIGURES

Other objectives of the invention will become apparent to those skilled in the art once the invention has been shown and described. The manner in which these objectives and other desirable characteristics can be obtained is explained in the following description and attached figures in which:

FIG. 7 is meant to illustrate and inventory some of the individual components of a dispenser 1. FIG. 7 also represents a flow-plan for fitting various components together to construct a dispenser 1.

Figure 1A:
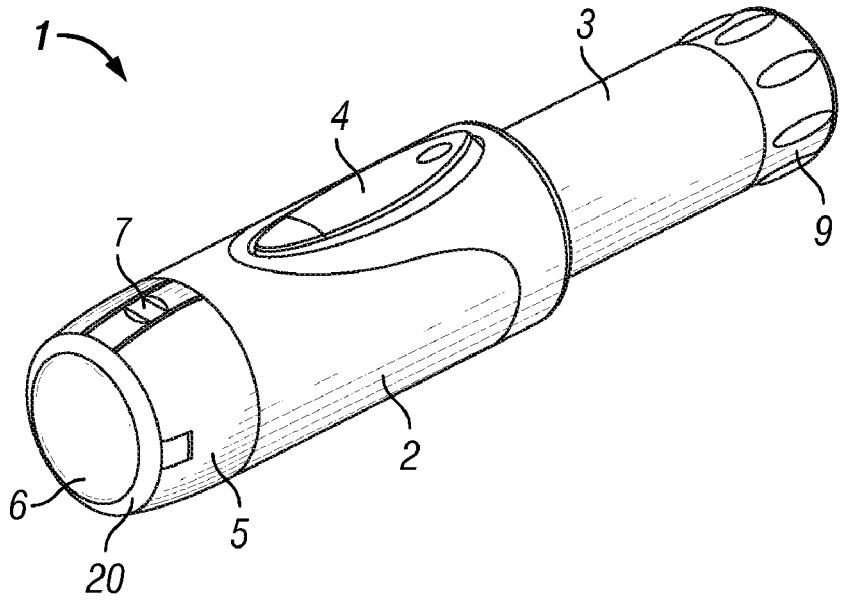
FIG. 1A is a perspective view of a dispenser 1, generally depicting a closed cap 6 and an extended plunger 3.

It is to be noted, however, that the appended figures illustrate only typical embodiments of this invention and are therefore not to be considered limiting of its scope, for the invention may admit to other equally effective embodiments that will be appreciated by those reasonably skilled in the relevant arts. Also, figures are not necessarily made to scale but are representative.

DETAILED DESCRIPTION OF PREFERRED EMBODIMENTS

In general, the dispenser 1 of the present application usually has a retractable barrel 10, which may be electively extended or retracted from an opening in the dispenser body 2. With the barrel extended, a pre-loaded solid and/or quasi-solid substance 11 may be coaxially shifted, back-and-forth along the barrel 10 length, whereby the user may project a distal end of the substance 11 from the muzzle 12 for topical application to a target via contact between the target and the projected substance 11. After application, the unapplied remainder of the projected substance 11 may be coaxially re-shifted within the barrel 10, and the barrel 10 retracted within the dispenser body 2 for interim preservation of the contained substance 11. The more specific elements and features of the dispenser 1 are illustrated by the drawings.

FIG. 1A is a three-dimensional rendering of the dispenser 1 in a closed configuration and represents the usual configuration of the dispenser 1 initially encountered by a user. The figure shows a tubular dispenser body 2 featuring a cap housing 5 at the first end, a coaxially merged plunger 3 at the second end, and an accessible button 4 on its outside surface. The cap housing 5 is integrally associated with the cap 6 to close and/or seal the opening 20. The plunger 3 is extended from the body 2 and may feature a circumferential grip 9 at the butt of the plunger 3. Finally, as discussed further below, the button 4 is suitably deactivated while the dispenser 1 is in this closed configuration because interaction with the button 4 presents no consequence.

Figure 1B:
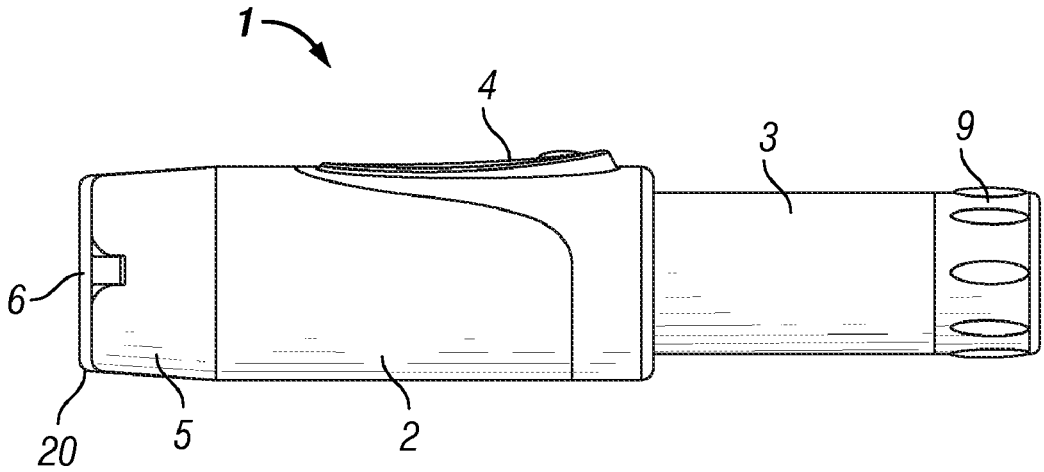
FIG. 1B is a side view of a dispenser 1 of FIG. 1A.

FIG. 1B is a side perspective of the closed dispenser 1 depicted in FIG. 1A. Though FIG. 1B shows the same features and components illustrated by FIG. 1A, FIG. 1B more fully depicts the coaxial merger and extension of the plunger 3 with the body 2, and the integral association of the cap 6 with the cap housing 5 to close and/or seal the opening 20. Also, FIG. 1B illustrates the accessibility and identification of the deactivated button 4 which is situated on, and suitably raised relative to, the outside surface of the dispenser body 2.

Figure 2A:
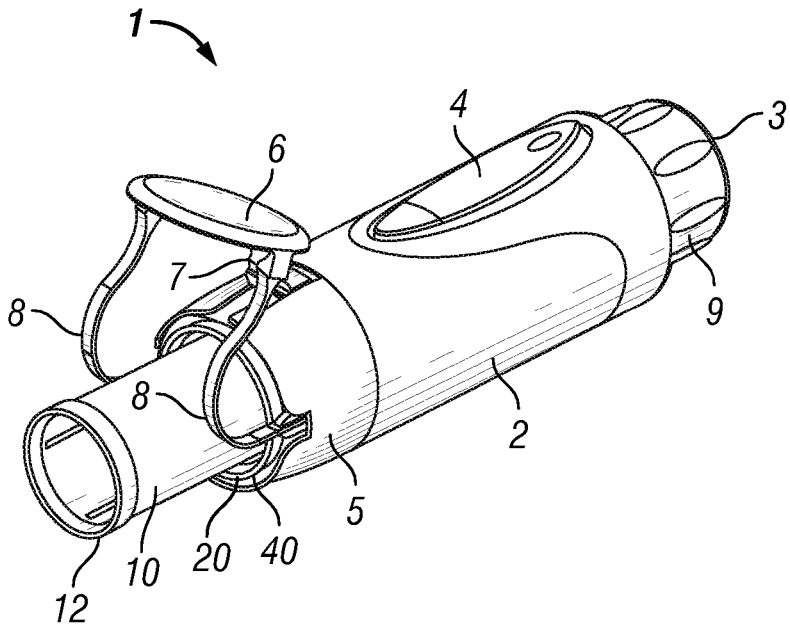
FIG. 2A is a perspective view of an open dispenser 1, generally depicting an open cap 6, an exposed barrel 10, and a depressed plunger 3.

FIG. 2A is a three-dimensional rendering of the dispenser 1 in an open configuration and represents an intermediate configuration of dispenser 1 typically encountered by a user. Like the previous figures, FIG. 2A shows the tubular body 2 featuring a cap housing 5 at one end, a coaxially merged plunger 3 at other end, and an accessible button 4 on its outside surface. However, unlike the previous figures, FIG. 2A depicts the cap 6 unassociated with the cap housing 5 to expose the opening 20, a barrel 10 protruding from the exposed opening 20, and a depressed plunger 3. In this figure, the cap 6 is separated from the cap housing 5 and held away from the opening 20 by flexor 7 and a pair of rigid, yet flexible, cap shoots 8. The plunger 3 is depressed coaxially within the hollow body 2, up to the circumferential grips 9, and the barrel 10 coaxially protrudes from the opening 20 whereby the barrel muzzle 12 extends distally beyond the other dispenser 1 parts and/or components (i.e., as discussed below, a contained substance 11 may be projected from the muzzle 12 and applied to a target without interference from the other parts/or components of the dispenser 1). FIG. 2A also depicts a seal 40 which may interact with the cap 6 and muzzle 12 while the dispenser 1 is closed to render the dispenser 1 substantially air and/or water tight. Finally, as discussed in further detail below, the button 4 is suitably activated while the dispenser 1 is in an open configuration.

Figure 2B:
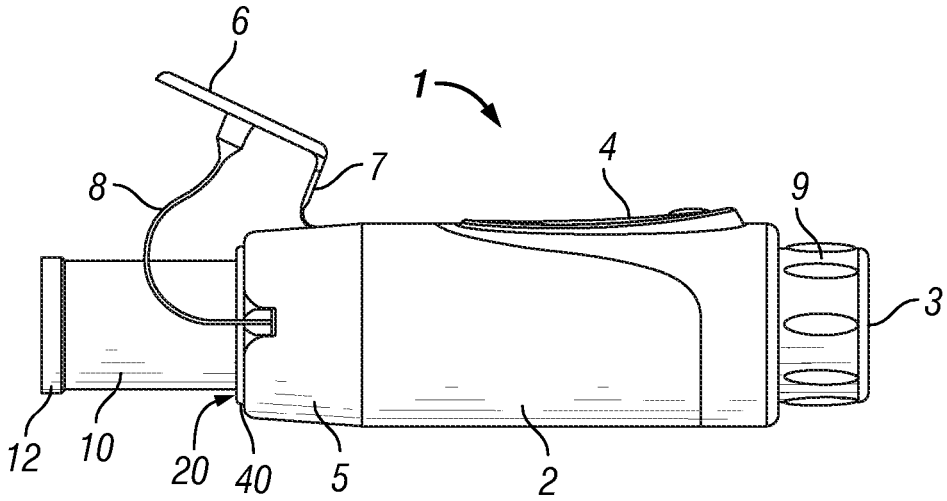
FIG. 2B is a side view of the dispenser 1 of FIG. 2A.

FIG. 2B is a side perspective of the open dispenser 1 depicted in FIG. 2A. Though FIG. 2B shows the same features and components illustrated by FIG. 2A, FIG. 2B more fully depicts the coaxial depression of plunger 3 within the hollow body 2 up to the grips 9, a button 4 (activated), and the protrusion of the barrel 10 from the opening 20. FIG. 2B also more fully illustrates the cap 6 held away from the opening 20 by cap shoots 8 and flexor 7. Finally, FIG. 2B depicts the distal extension of the muzzle 12 beyond other dispenser 1 parts and/or components.

FIGS. 1A through 2B in combination illustrate the transition from an open to a closed configuration. Beginning with a dispenser 1 in a closed configuration, as shown in FIGS. 1A and 1B, application of a depressive impulse to the butt of the plunger 3 coaxially forces the plunger 3 into the hollow body 2. The longitudinal force of the depressive impulse on the plunger 3 transfers among internal components to disassociate the cap 6 from the cap housing 5 by forcing the cap 6 longitudinally away from the opening 20 via the cap shoots 8 while the flexor 7 simultaneously draws the cap 6 radially away from the opening 20 whereby the opening 20 is unencumbered by the cap 6. Meanwhile, the same longitudinal force, transferred among internal components, suitably and simultaneously protrudes the barrel 10, and associated muzzle 12, from the exposed opening 20. Once the plunger 3 is fully depressed up to the grips 9, the cap 6 is suitably disassociated from the cap housing 5 to expose the opening 20, and the barrel 10 is protruded from the exposed opening 20, then the dispenser 1 is open as illustrated by FIGS. 2A and 2B.

Still referring to FIGS. 1A through 2B, it should be noted that even though the dispenser 1 is opened via plunger 3 depression, as discussed further below in connection with the later figures, the dispenser 1 features a continual resistance to dispenser 1 opening, which, unless overcome, prevents plunger 3 depression, opening 20 exposure, and barrel 10 protrusion. Additionally, if the resistance is not countered, the dispenser 1 rejects the plunger 3 from the body 2, withdraws the barrel 10 into the body 2, and closes and/or seals the opening 20 (i.e., reversion to the closed configuration illustrated in FIGS. 1A and 1B). Accordingly, the depressive impulse applied to the butt of plunger 3 must carry a force in excess of the resistance to result in plunger depression. In other words, absent specific action by the user, the cap 6 has an automatic bias towards a closed position. Moreover, also discussed further below, the dispenser 1 suitably features a means for countering the resistance to plunger 3 depression whereby the dispenser 1 may be kept open, without reversion to a closed state, long after dissipation of the depressive impulse.

As discussed below, the above mentioned resistance countering means is initiated by activating the button 4, and released by deactivating the button 4. A deactivated button 4, illustrated in FIGS. 1A and 1B, is activated by sufficient plunger 3 depression, but an activated button 4, as depicted by FIGS. 2A and 2B, is deactivated by deflecting the button 4 below the body 2 surface (i.e. pressing the button 4). Accordingly, a dispenser 1 in an open configuration illustrated by FIGS. 2A and 2B automatically reverts to a closed configuration by pressing the activated button 4 to release the above mentioned resistance.

Figure 3A:
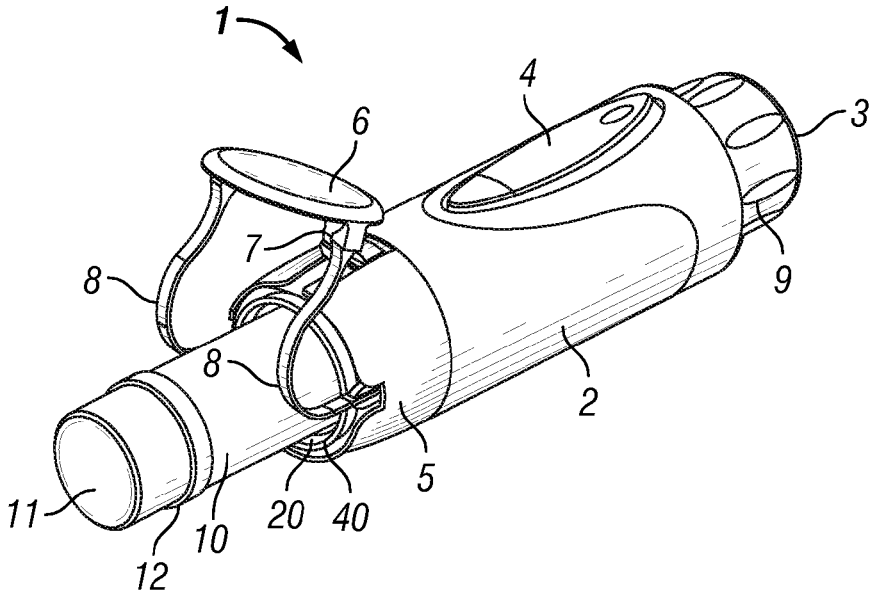
FIG. 3A is a perspective view of a delivering dispenser 1, generally depicting an open cap 6, an exposed barrel 10 which is posed for topical delivery of contained substance 11, and a depressed plunger 3.

FIG. 3A is a three-dimensional rendering of the dispenser 1 in a dispensing configuration whereby a user may apply a protective, occlusive, cosmetic, or medicated layer to a target region via contact with the projected substance 11. This figure illustrates the final configuration of the dispenser encountered by a user before application of the contained substance. FIG. 3A is essentially the same as FIG. 2A, except, FIG. 3A depicts a portion of contained substance 11 projected from the muzzle 12.

Figure 3B:
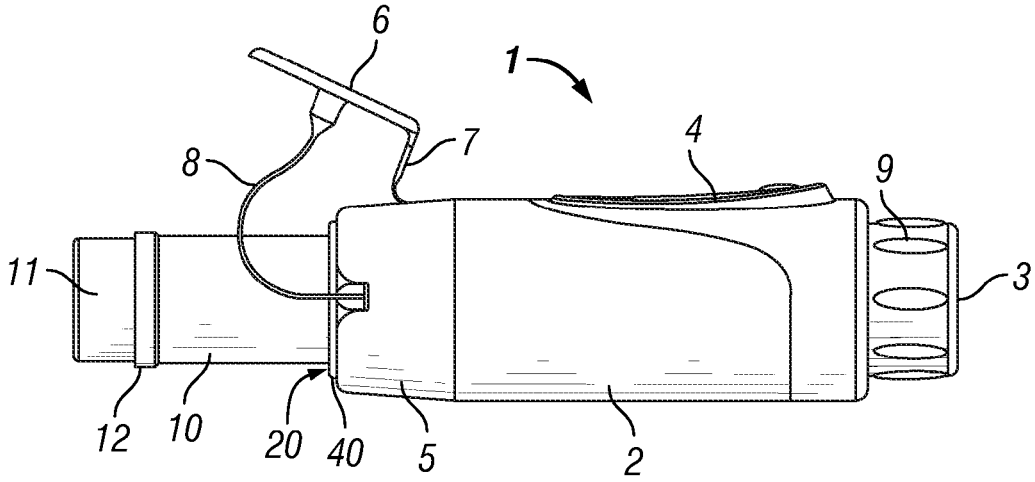
FIG. 3B is a side view of the dispenser 1 of FIG. 3A.

FIG. 3B is a side perspective of the dispensing configuration illustrated in FIG. 3A. Though FIG. 3B shows the same features and components illustrated by FIG. 3A, FIG. 3B more fully depicts the un-interfered projection and/or application of contained substance 11 from the muzzle 12.

FIGS. 2A through 3B illustrate the transition from an open configuration to a dispensing configuration. Typically, while the dispenser 1 is opened, as illustrated by FIGS. 2A and 2B, the contained substance 11 can be projected from the muzzle 12, as illustrated by FIGS. 3A and 3B, whereby the contained substance 11 may be suitably applied to a target. Though the internal mechanism is discussed further below in connection with the later figures, a substance 11 is electively projected from or withdrawn within the muzzle 12 by rotating the depressed plunger 3 relative to the dispenser body 2 via applied torque to the circumferential grips 9. For example, referring to FIGS. 2A and 2B initially, a user may torque the plunger 3 via the grips 9 in one direction to project the contained substance 11 from the muzzle 12, as depicted in FIGS. 3A and 3B; after application to the desired target, a user may withdraw the projected substance 11 back through the muzzle, to the position illustrated in FIGS. 2A and 2B, by torquing the plunger 3 in the opposite direction.

Accordingly, typical dispenser 1 use will consist of the user performing the following in series: (1) a coaxial depressive impulse on the plunger 3 butt sufficient to overcome the dispenser 1 resistance thereto and sufficient to lock the dispenser open by activating the button 4 (FIG. 1A to 2A); (2) concentrically twisting the plunger 3 in one direction relative to the dispenser body 2 until a sufficient volume of contained substance 11 is projected from the muzzle 12 (FIG. 2A to 3A); (3) application of contained substance to a target; (4) twisting the plunger 3 in the other direction (opposite the twisting direction of step (2) above) relative to the dispenser body 2 until the remainder of the projected substance 11 re-enters the muzzle 12 (FIG. 3A to 2A); and, (5) pressing the activated button 4 to unlock the open dispenser 1, thereby permitting the resistive force to close the dispenser 1 (FIG. 2A to 1A). Some steps may optionally be omitted.

Figure 4A:
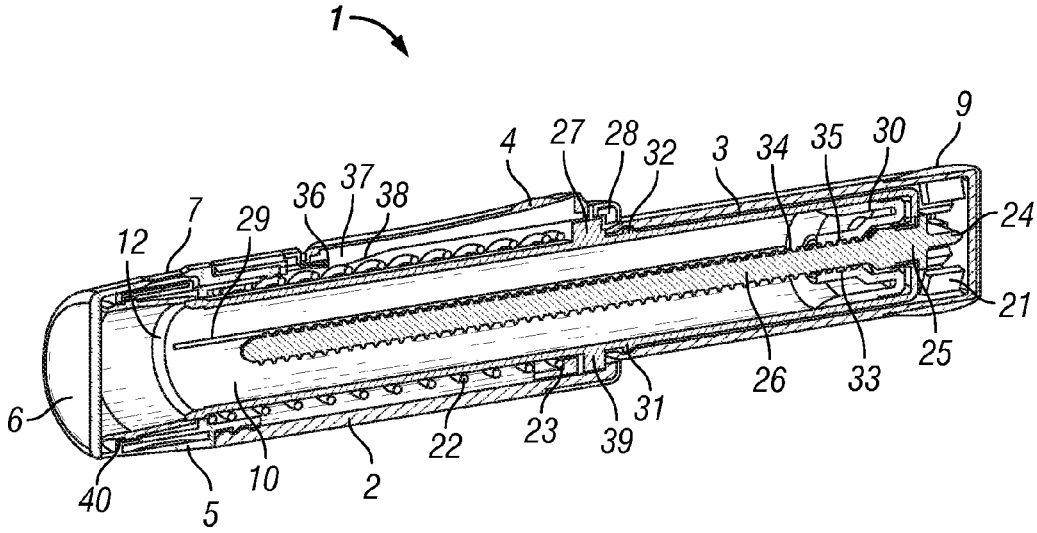
FIG. 4A is a three-dimensional longitudinal bisection of an empty dispenser 1 which generally depicts the location of internal components of the dispenser 1 while the cap 6 is closed and a plunger 3 is extended.

FIG. 4A is a three-dimensional longitudinal bisection of an empty dispenser 1 and depicts the relative locations of internal components while the dispenser 1 is in a closed configuration. The dispenser 1 is empty because a contained substance 11 is not depicted. FIG. 4A shows the inner perspective of a hemisphere of the tubular dispenser body 2 featuring: a cap housing 5 with closed cap 6 at the first end; on the other end, an extended plunger 3 featuring circumferential grips 9 on its butt and a circumferential groove 32 on its inside surface; and, an inactivated button 4 on its outside surface. FIG. 4A also depicts the innards of the closed dispenser 1, namely: a seal 40 within the cap housing 5 which suitably presses against the cap 6 while the cap 6 is closed; an empty barrel 10 which is concentrically nested within the plunger 3 and body 2, wherein the barrel 10 features a muzzle 12 at one end, a rotably positioned projector 25 (defined by a shaft 26 and a driver 24) at the other end which extends axially within the barrel, a latching member 27 adjacent to a tongue 31 on its outside surface, and a longitudinal plug track 29 on its inner surface; a plug 30 which is slidably positioned within the barrel 10 along plug track 29 wherein the shaft 26 passes through the plug channel 33; a reversion spring 22 usually in equilibrium while the dispenser 1 is closed; a spring stop 23 which is integrally associated with the cap shoots 8 and which is adjacent to press 39; and, a plurality of crank teeth 21, internally situated radially at the base of plunger 3 and extending longitudinally along the inner wall of the plunger 3 to approximately the same extent as grips 9 on the outside surface.

Figure 4B:
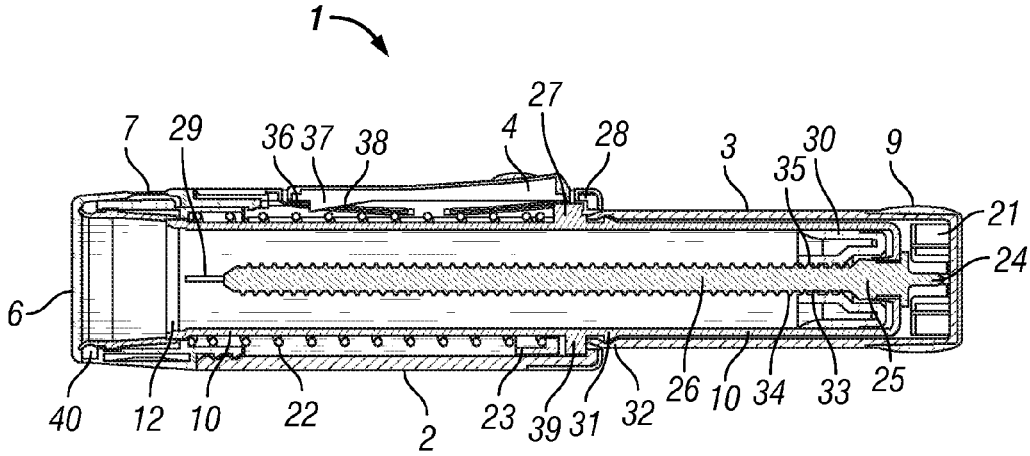
FIG. 4B is an ordinary longitudinal cross-section of an empty dispenser 1 of FIG. 4A.

FIG. 4B is a typical longitudinal cross-section of an empty dispenser 1 illustrated in FIG. 4A. FIG. 4B is similar to FIG. 4A but, FIG. 4B more readily depicts the relative locations of the internal components of the dispenser 1 while the dispenser 1 is closed. For example, the cap shoots 8 (see FIG. 7 for a depiction), reversion spring 22, spring stop 23, and barrel 10 (from the muzzle 12 to the latching member 27) are all internal to the body 2 and cap housing 5; meanwhile, the remainder of the barrel 10, projector 25, and crank teeth 21 are internal to the fully extended plunger 3.

FIGS. 4A and 4B, together, illustrate a number of elements featured by a closed dispenser 1. First, the figures depict a void defined by the volume created by the cap 6, the inner seal 40 wall, and the muzzle 12 whereby, as discussed further below, the void may accommodate dispenser 1 closure despite residual projection of contained substance 11 from the muzzle 12 (see discussion of FIGS. 7A and 7B below). Also, depending on the force at which the cap 6 and muzzle 12 are held against the seal 40, the dispenser may be made substantially air or water tight via deformation of the seal 40 against the cap 6. The force at which the cap 6 may be held against the seal 40 can be varied by adjusting (or applying) an expansive force of the reversion spring 22 against the spring stop 23 while the dispenser 1 is closed so that the expansive force will pull the cap shoots 8 and press the cap 6 against the seal 40. Second, FIGS. 4A and 4B depict the relationship between the plunger 3 and the barrel 10. As illustrated by these figures, the barrel 10 (from just after the latching member 27 to the projector 25) concentrically nests within the plunger 3 seemingly according to the matryoshka principle except that the driver 24 (which extends from the butt of barrel 10 and which approximately spans the internal diameter of the plunger 3) inserts between opposing sets of adjacent crank teeth 21 at the butt of the plunger 3 (similar to a flat-head screwdriver inserting into a flat-head screw). The barrel 10 and the plunger 3 suitably retain their matryoshka-like relationship via a circumferential tongue 31 on the outer surface of the barrel 10 (situated between the latching member 27 and the barrel 10 butt) and the circumferential groove 32 on the inner surface of the plunger 3. Finally, FIGS. 4A and 4B depict the first utility of the latching member 27, wherein the latching member 27 interacts with body edge 28 (located at the body 2/plunger 3 merger) to prevent the barrel 10, and associated plunger 3, from sliding outside the body 2 beyond full plunger 3 extension illustrated in FIGS. 4A and 4B.

FIGS. 4A and 4B also depict the elements of a deactivated button 4. As the figures illustrate, the deactivated button 4 features an upper surface profile which is suitably flush with the outside surface of the body 2 at the fore of the button 4 towards the cap housing 5, but which upper button 4 surface gradually raises relative to the outside surface of the body 2 towards its aft. The lower surface profile of the button 4 is essentially flat along the length, except for a downward wedge 37(featuring a ledge 36 and tapering surface 38) below the fore of the button 4. As discussed in further detail below, the button 4 typically represents a downward pivoting structure which, as depicted in FIGS. 4A and 4B, is deactivated because the top surface of the latching member 27 abuts the flat portion of the lower profile of the button 4 beneath its aft, thereby preempting a downward button 4 pivot and/or displacement.

Figure 5A:
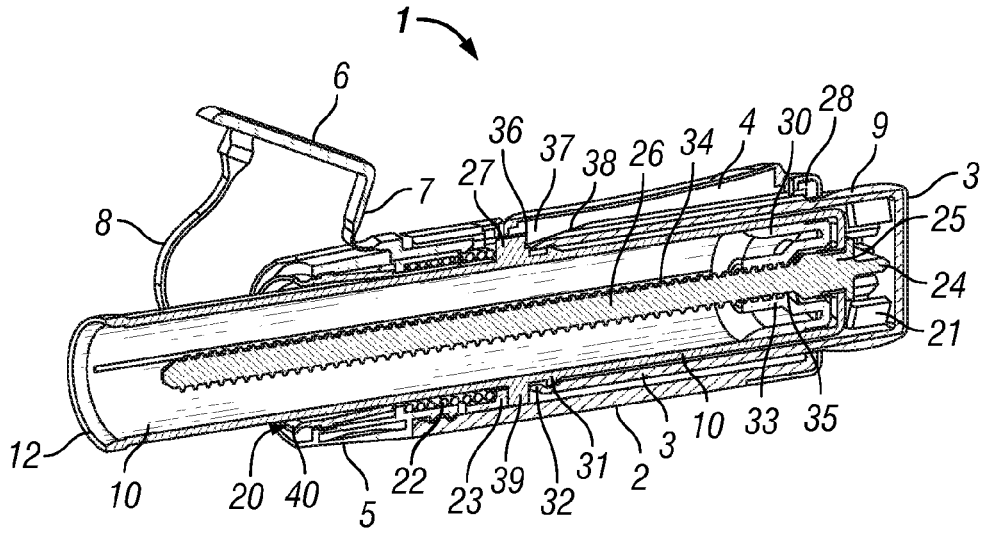
FIG. 5A is a three-dimensional longitudinal bisection of an unloaded dispenser 1 which generally depicts the situation of internal components of the dispenser 1 while the cap 6 is open, the barrel 10 is exposed, and the plunger 3 is depressed.

FIG. 5A is a three-dimensional longitudinal bisection of an empty dispenser 1 which depicts the relative locations of internal components while the dispenser 1 is in an open configuration. FIG. 5A shows the inner perspective of a hemisphere of the tubular dispenser body 2 featuring: at the first end, a cap housing 5 with an open cap 6 being held away and back by cap shoots 8 and flexor 7; at the other end, a plunger 3 which is coaxially depressed up to the grips 9 and which features an inside groove 32; and, an activated button 4 on its outside surface. Similar to FIG. 4A, FIG. 5A also depicts the innards of the open dispenser 1 except that the reversion spring 22 is compressed between the spring stop 23 and cap housing 5, the latching member 27 is integrally associated with the ledge 36 of the activated button 4, and the rest of the internal components are shifted relative to the body 2, consistent with plunger 3 depression.

Figure 5B:
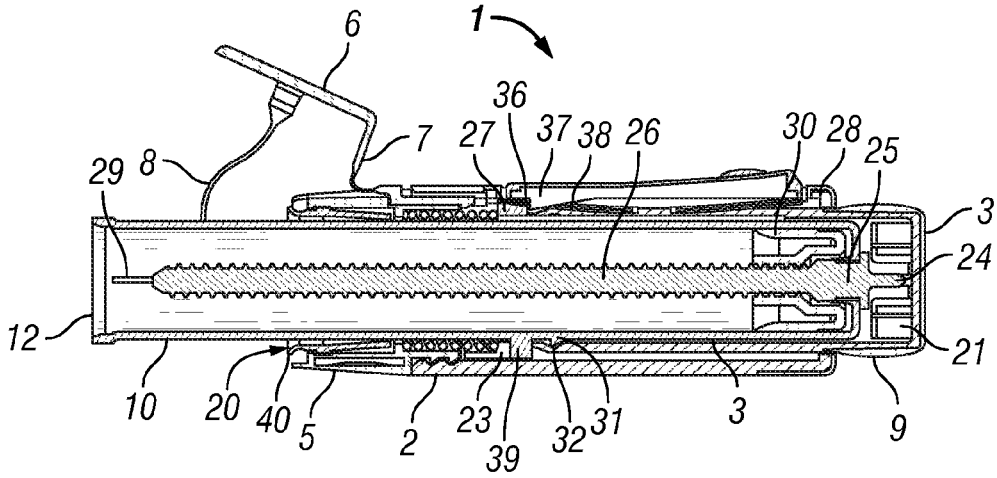
FIG. 5B is an ordinary longitudinal cross-section of an empty dispenser 1 of FIG. 5A.

FIG. 5B is a typical longitudinal cross-section of an empty dispenser 1 illustrated in FIG. 5A. FIG. 5B is similar to FIG. 5A but, FIG. 5B more readily depicts the features of an activated button 4, and the compression of the spring 22 against the spring stop 23 and the cap housing 5.

FIGS. 4A through 5B in combination illustrate suitable mechanisms for the transition between open and closed dispenser 1 configurations. As discussed above, beginning with a dispenser 1 in a closed configuration as shown in FIGS. 4A and 4B, an application of a depressive impulse to the butt of the plunger 3 coaxially forces the plunger 3 into the hollow body 2. The longitudinal force of the depressive impulse on the plunger 3 slides the barrel 10 against the semi-circumferential spring stop 23 at the corresponding press 39 on the barrel 10 which transfers the longitudinal force of the depressive impulse to the spring stop 23, whereby the spring stop 23 compresses the spring 22 against the cap housing 5, and whereby the spring stop 23 transfers the same depressive force to the cap shoots 8 associated therewith. Under this force, the cap shoots 8 extrude from the cap housing to move the cap 6 longitudinally away from the seal 40 and opening 20 while the flexor 7 simultaneously draws the cap 6 radially away from the opening 20 whereby the opening 20 is unencumbered by the cap 6. Meanwhile, the barrel 10 continues to slide longitudinally through the body under the initial depressive force until the barrel 10, and associated muzzle 12, protrude from the exposed opening 20. Once the plunger 3 is fully depressed up to the grips 9, the cap 6 is disassociated from the cap housing 5 to expose the opening 20, and the barrel 10 is protruded from the exposed opening 20, the dispenser is open as illustrated by FIGS. 5A and 5B.

Compressing the reversion spring 22 between the cap housing 5 and the spring stop 23 creates the continual resistance to dispenser 1 opening referred to above because the expansive force of the spring pushes against the spring stop 23 to force the barrel 10 (via press 39) and cap shoots 8 back into the body 2, and the plunger 3 out of the body 2 thereby closing the dispenser 1. Though the figures depict reversion spring 22 as the natural resistance, an internal compression spring is not the only means for inducing the aforementioned natural tendency. Such continual resistance may be invoked internally or externally through the use of magnets, elastics, rubbers, manual or any other attractive or repulsive force.

FIGS. 5A and 5B depict the features of an activated button 4 which, when activated, represents a means for countering the automatic bias of the cap 6 towards a closed position. These figures depict the latching member 27 beneath the aft of button 4 and pressed against the ledge 36 of the wedge 37 on the undersurface of the button 4 by the compressed reversion spring 22. In fact, interaction between the ledge 36 of the wedge 37 prevents reversion spring 22 expansion, thereby locking the dispenser in an open configuration, as alluded to above. FIGS. 5A and 5B depict an activated button 4 because a downward deflection of the button 4 (relative to the outer surface of the body 2) at its aft, suitably raises the button 4 fore and the ledge 36 of the wedge 37 beyond latching member 27 interaction, which in turn permits reversion spring 22 expansion and the associated reversion of the dispenser 1 to a closed configuration.

FIG. 4A through 5B illustrate activation and deactivation of the button 4 with plunger depression and reversion respectively. Initially, the flat portion of the undersurface of the button 4, abuts the top of the latching member 27 beneath the aft, thereby deactivating the button 4 (FIGS. 4A and 4B). In response to a depressive impulse on the butt of plunger 3, the reversion spring 22 compresses between the cap housing 5 and the spring stop 23 while the cap 6 opens and the barrel 10 (and associated components) shift toward the opening 20. As the barrel 10 slides within the body 2, the latching member 27 slides along the flat undersurface until it meets the wedge, whereafter the depressive impulse interacts with the taper via the latching member 27 to raise the fore of the button 4, thereby causing a downward pivot at the aft. Once the latching member 27 has passed the pinnacle of the wedge 37, the button 4 return pivots (via balance) and the ledge 36 of the wedge 37 interacts with the latching member 27 to prevent reversion spring 22 expansion (FIGS. 5A and 5B). If the button is thereafter deflected downward at the aft, the ledge 36 and latching member 27 will disassociate as described above, and the reversion spring 22 will force the latching member 27 back along the tapered and flat portions of the underside of the button 4 to a closed dispenser 1 configuration (FIGS. 4A and 4B). Accordingly, a dispenser 1 may be electively opened and closed via complete plunger 3 depression followed by downward deflection of the activated button 4 at its aft.

FIG. 6A through 6D are typical longitudinal cross-sections of a loaded dispenser 1 which illustrate the transition from closed to dispensing dispenser 1 configurations. The dispenser 1 is loaded because the figures depict contained substance 11 within the barrel 10. While these four figures generally depict all the features and elements illustrated by the earlier figures in connection with the dispenser 1, FIGS. 6A through 6D focus on the mechanism for elective shifting the contained substance 11, back-and-forth along the barrel 10, to project and/or withdraw contained substance 11 from the muzzle 12.

Figure 6A:
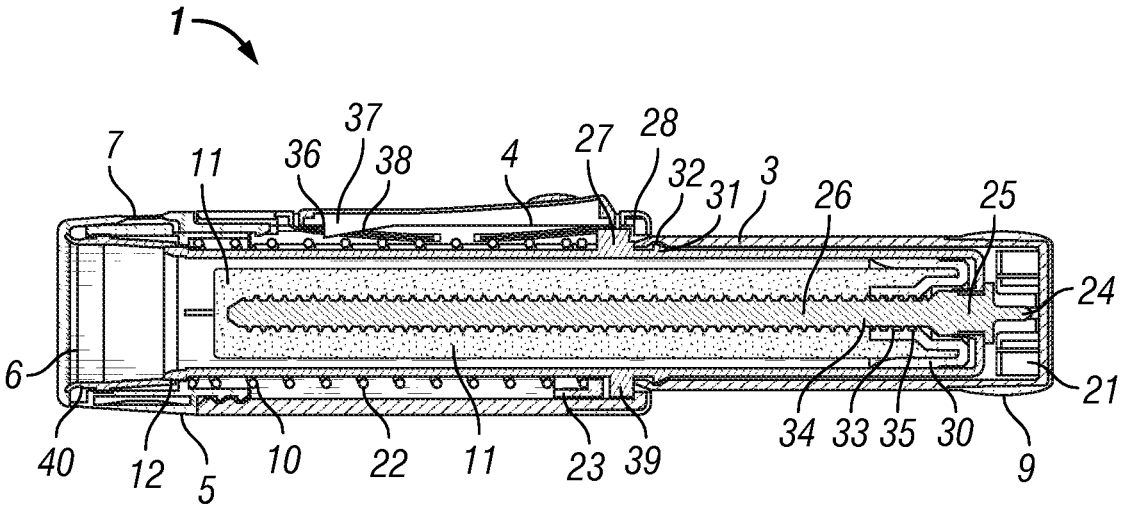
FIG. 6A is an ordinary longitudinal cross-section of a closed and loaded dispenser 1 which generally depicts the location of internal components in the dispenser 1 while the cap 6 is closed and a plunger 3 is fully extended.
Figure 6B:
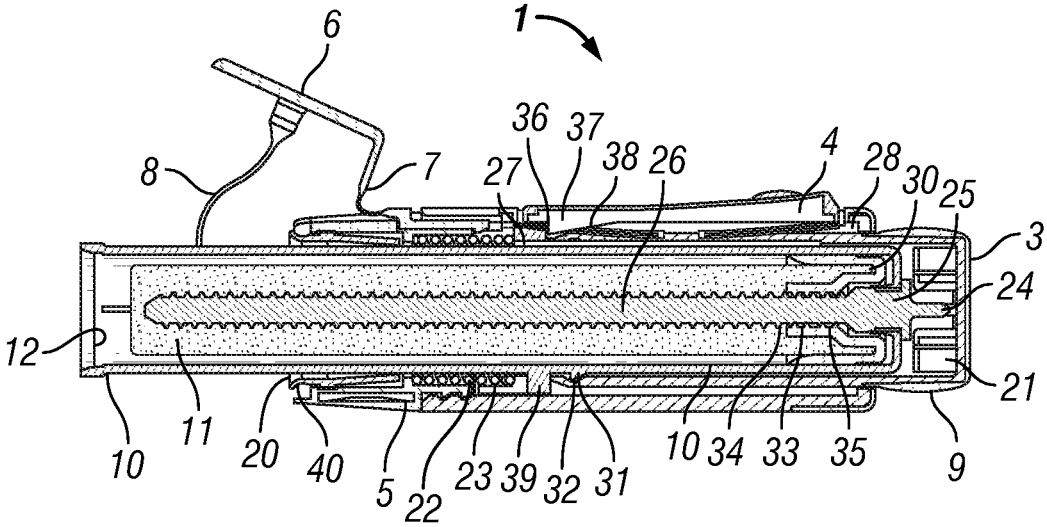
FIG. 6B is an ordinary longitudinal cross-section of an open and loaded dispenser 1 which generally depicts the location of internal components of the dispenser 1 while the cap 6 is open, the barrel 10 is exposed, and a plunger 3 is fully depressed.

First, a closed dispenser 1 as depicted by FIG. 6A may be locked open by a depressive impulse at the plunger 3 butt as described above. Second, while the dispenser 1 is open, as depicted by FIG. 6B, the contained substance 11 can be projected from the muzzle 12, as illustrated by FIG. 6C, whereby the contained substance 11 may be suitably applied to a target. Typically, concentric rotation of the plunger 3 relative to the body 2 and/or barrel 10 via a twisting force applied to the grips 9, which torque causes the crank teeth 21 to interact with the driver 24 whereby the shaft 26 of the projector 25 (which have been rotably coupled to the butt of the barrel 10) rotates to the same extent as the plunger 3. Rotation of the shaft 26 causes the screw threads 34 thereon to interact with the nut threads 35 within the plug channel 33, whereby the plug 30, and the contained substance 11 therewith, move along the length of the shaft 26 along the plug track 29 toward eventual projection at the muzzle 12, as depicted by FIG. 6C. The plug 30 does not rotate with the shaft 26 because the plug 30 is prevented from rotation relative to the barrel 10 by interaction between the plug blades 41 and the plug channel 29. Interaction between the plug blades 41 and the plug channel 29 also guides the movement of the plug back and forth along the barrel 10. Once the desired projection of the contained substance is achieved, rotation of the plug 3 relative to the body 2 and/or barrel 10 is typically discontinued. Third, the projected portion of the contained substance 11 may be applied to a target via contact between the contained substance and the target. Fourth, reverse rotation of the plunger 3 relative to the body 2 and/or barrel 10 via an opposite twisting force at the grips 9 causes rotation of the shaft 26 to in the same direction. This reverse rotation induces reverse movement of the plug 30, via screw thread 34 and nut thread 35 interaction, back within the barrel 10 along the plug track 29 whereby the unapplied projected substance 11 returns within the barrel as depicted in FIG. 6B. Fifth, the activated button 4 is pressed and the dispenser closes as described above and depicted in FIG. 6A.

Figure 6D:
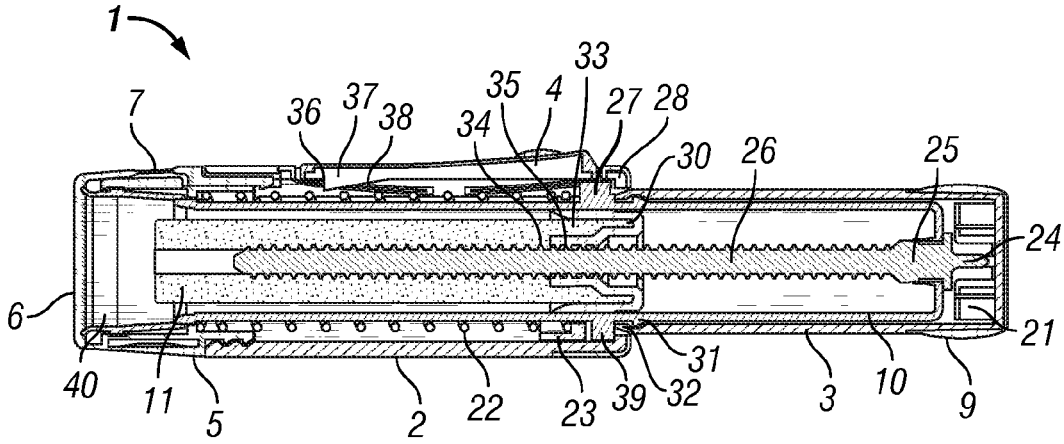
FIG. 6D is an ordinary longitudinal cross-section of a closed dispenser 1 wherein the cap 6 is associated with the cap housing 5 yet substance 11 is still projected from the muzzle.
Figure 6C:
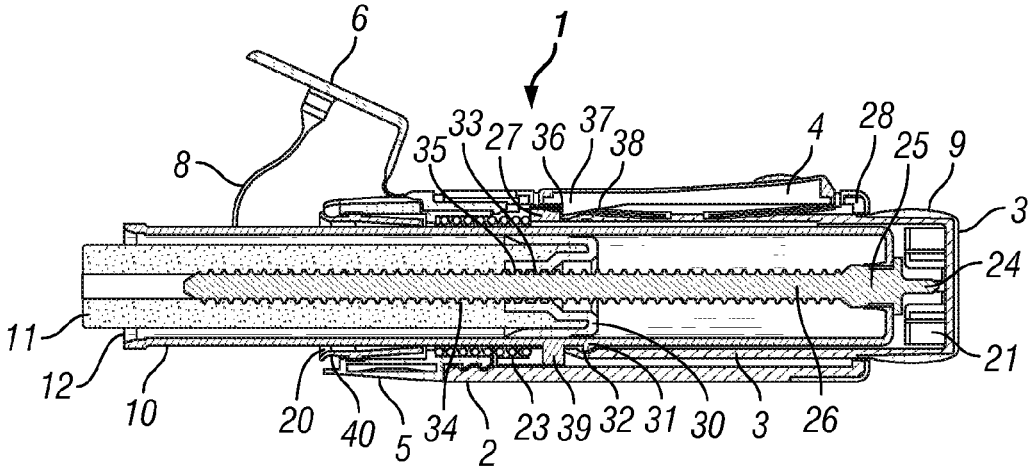
FIG. 6C is an ordinary longitudinal cross-section of an open dispenser 1 wherein the contained substance 11 is projected from the muzzle 12 and which figure generally depicts the location of internal components in the dispenser 1 while the cap 6 is closed and a plunger 3 is fully extended.

Alternatively, instead of projecting the substance after the dispenser 1 is open, a portion of the contained substance may be projected from the muzzle internal to the dispenser 1 before and during the dispenser 1 opening, as depicted in FIG. 6D. As discussed above, a void exists within a closed dispenser 1 between the cap 6 and the muzzle 12 wherein the empty volume may suitably be occupied by a projected portion of the contained substance 11. Similarly, instead of returning the unapplied projected substance 11 within the barrel after application, the unapplied substance 11 may continue to project from the muzzle 12 during and after dispenser 1 closure. The extent to which the projected substance may be projected during dispenser 1 opening or closure without obstructing the mechanism will be readily ascertainable to one skilled in the art.

Figure 7:
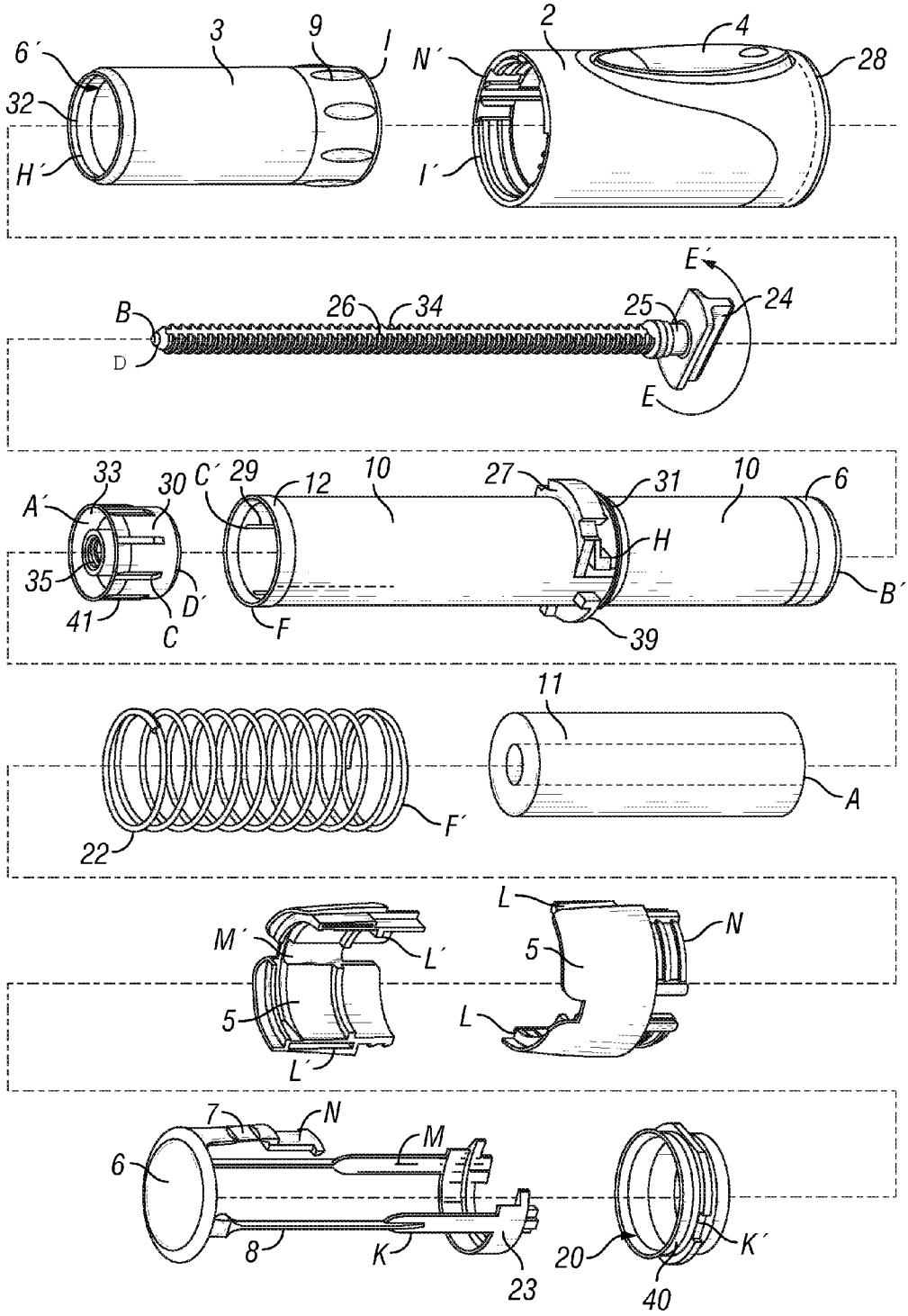
FIG. 7 is an exploded dispenser 1 of FIGS. 1A through 6D.

FIG. 7 is an exploded view of the dispenser 1 depicted in the figures. FIG. 7 is an inventory of parts, and a construction diagram for the dispenser 1 of FIGS. 1A through 6D. The components generally fit together by following the dashed line from the top left to the bottom right of the FIG. 7. More specifically, the dispenser may be constructed as follows: (1) a solid/semi-solid substance 11 is loaded into the plug 30 such that the substance 11 surrounds the plug channel 33 (A to A'); (2) the shaft 26 of the projector 25 coaxially inserted at the butt of the barrel 10 up to the driver 24, wherein the projector 25 is rotably fixed to the butt of the barrel 10 (B to B'); (3) the plug 30 and contained substance 11 assembly is inserted into the barrel 10 via the muzzle, such that the plug blades 41 slidably interact with the plug track 29 (C to C') and the shaft 26 rotably inserts with the plug channel 33 (D to D'); (4) the shaft 26 must be torque relative to the barrel 10 (E to E') so that the helical screw threads 34 on the shaft 26 interact with the corresponding nut threads 35 in the plug channel 33 to draw the plug 30 and substance 11 assembly within the barrel 10 along the plug track 29; (5) the muzzle 12 of the barrel 10 is inserted within the reversion spring 22 until the reversion spring 22 meets the spring stop 23; (6) the butt of the barrel 10 and the associated driver 24 are nested within the plunger 3 (G to G') such that the driver 24 interacts with opposing and adjacent crank teeth 21 (as discussed above in connection with FIGS. 4A and 4B) and the tongue 31 interacts with the circumferential groove 32 (H to H'); (7) insert the plunger 3 and barrel 10 assembly into the body 2 (I to I') until the plunger 3 extends fully from the body 2 and the latching member 27 meets the body edge 28 (J to J'); (8) the cap 6 and cap shoot 8 assembly is placed around the seal 40 (K to K'); (9) the two hemispheres of the cap housing 5 are brought together around the seal 40, cap 6, and cap shoot 8 assembly (L to L') such that the cap shoots align with the path 42 on the inner surface of the cap housing 5 (M to M'); and, (10) the cap housing 5 is inserted and fixed to the body 2 (N to N').

After contained substance 11 stock is sufficiently diminished by dispenser 1 use, the dispenser 1 may be disposed of or replenished with substance 11. If replenishment of substance is desired, usually the dispenser 1 is held open and the plug 30 removed, followed by reinsertion of a stocked plug. This application contemplates that a dispenser 1, and plug, may be either disposable or refillable.

The figures depict the dispenser 1 with a rigid but hollow tubular body 2, a rigid but hollow cylindrical plunger 3, and other components of various shapes and relative sizes. However, the body 2 and plunger 3 need not be tubular or cylindrical but may be any shape seen fit by a person skilled in the applicable art. In addition to cylinders, other shapes, including, but not limited to squared, polygonal shapes, may be employed. Similarly, the various components shape and relative size may also be so modified. For example, a dispenser 1 depicted by the figures may have the general appearance of a right cylinder, but the general appearance may also be that of any three-dimensional object.

The materials suitable for forming the dispenser 1 and its components will vary depending on the physical properties of the substance contained, and the nature of the expected dispenser 1 use. The proper combination of materials for contained substance will be readily apparent to those skilled in the art. Keeping that in mind, the components of a dispenser 1 may be formed using a variety of preferable materials, including but not limited to metals, alloys, composites, woods, and a variety of hard plastics including but not limited to high-density polyethylene, polypropylenes, PVC, and other materials that will be appreciated by those skilled in the art.

In summary, the present application contemplates a solid and/or semi solid substance dispenser 1 comprising of a body 2, an opening 20 at which an electively retractable barrel 10 may be extended or withdrawn. Further, a solid or semi-solid substance may be projected from the barrel for application of the substance to a target.

A typical solid and/or semi solid substance dispenser 1 minimally comprises the following: a body 2; at least one opening 20; an electively retractable barrel 10; a means for electively extending said barrel 10 from said opening 20; a means for electively retracting said barrel within said opening 20; a means for containing a solid and/or semi-solid substance 11 within said barrel 10; and, a means for electively projecting said substance 11 from said barrel 10.

It should be noted, that the above specification describes only typical embodiments of this invention and is therefore not to be considered limiting of its scope, for the invention may admit to other equally effective embodiments and components that will be appreciated by those reasonably skilled in the relevant arts.

We claim:

1. A substance dispenser comprising:

a body;

at least one opening;

an electively retractable barrel;

a means for electively extending said barrel from said opening;

a means for electively retracting said barrel within said opening;

a means for containing a solid and/or semi-solid substance within said barrel;

a means for electively projecting said substance from said barrel;

a locking means whereby said means for retracting said barrel within said opening may be prevented;

an unlocking means whereby said locking means is released; and, wherein said locking mean is a latching member which protrudes from the outer surface of the barrel and a wedge which is situated within said body.

2. The substance dispenser of claim 1 wherein said latching member and said wedge are features of a button which is accessible on the outer surface of said body.

3. A substance dispenser comprising:

a body;

a cap housing occupying a first end of said body;

an electively retractable barrel featuring a muzzle at one end, a butt at another end, a track on its inside surface, and a latching member on its outer surface;

a projector featuring a shaft and a driver, wherein said projector is rotably attached to said butt of said barrel such that said shaft extends coaxially from said butt of said barrel toward said muzzle of said barrel and such that the driver extends distally from said butt of said barrel in the opposite direction, and wherein said shaft features nut threads;

a plunger depressibly extending from a second end of said dispenser body, wherein said plunger internally features crank teeth, and wherein said barrel is nested within said plunger, said butt first, seemingly according to the matroyshka principle whereby the driver is inserted between a set of crank teeth, and wherein depression of said plunger within said body extends said muzzle from said opening;

a spring which compresses upon depression of said presentation of said muzzle at said opening wherein expansion of said spring retracts said muzzle within said opening;

a button which is accessible on the outside surface of said body, wherein said button features an upper and lower surface and wherein said lower surface features a wedge operationally configured to block the latching member if the latching member slides beyond the pinnacle of the wedge whereby said spring cannot expand unless the button is pressed;

a cap operationally configured to associate with said cap housing to shut said opening;

at least one cap shoot operationally configured to transfer a portion of the force derived from said plunger depression to said cap whereby the cap is disassociated from said cap housing and opens said opening, and operationally configured to transfer a portion of the expansive force derived from said expansion of said spring to associate said cap with cap housing; and, a plug capable of holding said substance wherein said plug is slidably positioned within said barrel to coaxially interact with said shaft within said barrel such that upon rotation of said shaft, the plug slides longitudinally within said barrel and wherein said plug may be moved within said barrel to project said substance from said muzzle.

* * * * *